US005472588A

United States Patent [19]

Woog

[11] Patent Number: 5,472,588

[45] Date of Patent: Dec. 5, 1995

[54] SILVER RECOVERY CELL WITH ADAPTER

[76] Inventor: Gunter Woog, 5435 Bauers Dr., West Bend, Wis. 53095

[21] Appl. No.: 289,655

[22] Filed: Aug. 12, 1994

[51] Int. Cl.[6] ..... C25C 7/00; C25D 17/00

[52] U.S. Cl. ..... 204/275; 204/271; 204/279

[58] Field of Search ..... 204/275–278, 204/271, 109, 279

[56] References Cited

U.S. PATENT DOCUMENTS 3,479,275 11/1969 Gwynn et al. ..... 204/275

4,276,147 6/1981 Epner et al. ..... 204/275 X

*Primary Examiner*—Donald R. Valentine

*Attorney, Agent, or Firm*—Ryan, Maki & Hohenfeldt

[57] ABSTRACT

A cell for electrolytic silver recovery is provided with a threaded fitting and can be connected to a conventional fluid flow fitting having a fluid flow inlet and outlet by means of a collar connecting the dissimilar threads of the fitting and the cell. The cell is connected by an electric lead to an outside source of power and contains an electrode in electrical contact with liquid in the cell and a second electrode in the form of a thin conductive coating on the interior of the cell.

2 Claims, 1 Drawing Sheet

SILVER RECOVERY CELL WITH ADAPTER

FIELD OF THE INVENTION

This invention relates to apparatus for recovering silver from photographic fixer solutions utilizing disposable cells and particularly to such systems using adapters to make them usable in conjunction with available low cost fittings.

BACKGROUND OF THE INVENTION

I have previously described silver recovery cells in my U.S. Pat. No. 5,017,273, issued May 21, 1991. Such cells utilize a disposable container in which a pair of electrodes is provided for electrolytically removing silver from solution. Such cells utilize one electrode in electrical contact with the liquid in the cell and a second electrode composed of a thin conductive film applied to the inside surface of the container that forms the cell.

Various low cost fittings are available for connecting cells to fluid flow conduits for example the type conventionally used for connecting filters to water lines for potable water, for example.

In accordance with the present invention, such cells are connected by means of an adapter to conventional fittings even though incompatible thread systems are utilized.

Briefly, the invention provides a container for electrolytic silver recovery including a connector for electrical connection to an outside electrical power source and a pair of electrodes, one of the electrodes being in electrical contact with liquid contained in the container and the other electrode being affixed and in electrical contact with a metallic thin conductive film applied to an inside surface of the container. The container is provided with a set of threads having a first set of dimensions including thread depth and pitch. The assembly includes a fluid flow fitting having a first end with a fluid flow inlet and a fluid flow outlet and a set of threads formed on a surface of the fitting having a second set of dimensions including thread depth and pitch said second set of dimensions being different from said first set of dimensions, both of said inlet and said outlet being in fluid flow communication with the interior space defined by said set of threads.

A collar is provided for connecting the silver recovery container to the fitting the collar having at its opposite ends a first set of threads mating with the first set of threads of said container and a second set of threads mating with said second set of threads of said fitting.

These and other objects and advantages of the invention will be apparent from the following detailed description and accompanying drawings.

DETAILED DESCRIPTION OF A PREFERRED EMBODIMENT

Figure 1:
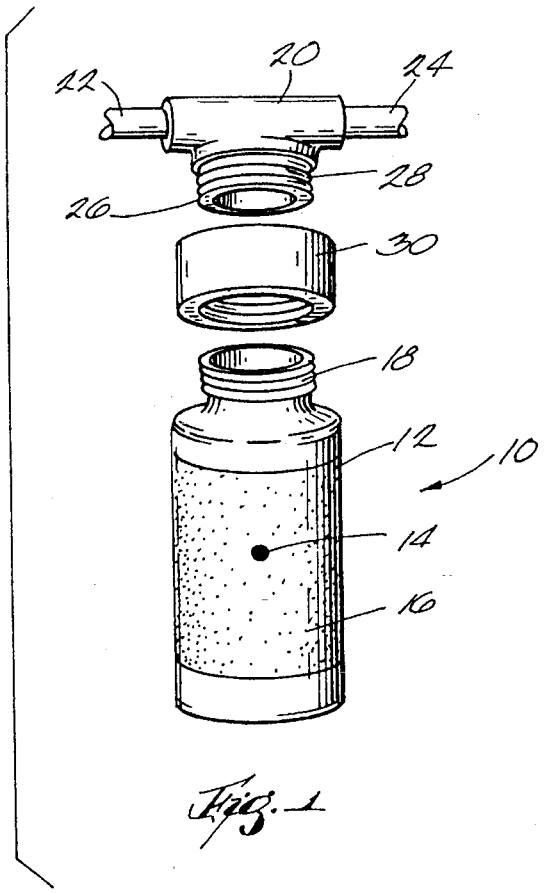
FIG. 1 is side elevational view showing the components of the invention and disassembled relationship.

Referring more specifically to drawings, there is shown a silver recovery assembly 10 including a silver recovery cell 12 in the form of an enclosed container. Cell 12 is provided with an electrical lead 14 electrically connected to a coating 16 on the interior of container 12 that forms an electrode. The upper end of container 12 is provided with threads 18 generally of a fine pitch and depth.

A fitting 20 is provided for connection of cell 12 to a source of fixer solution liquid generally outflow from a photographic developer device, X-ray machine or the like. Inlet conduit 22 is connected to fitting 12 to discharge liquid into cell 12 when it is connected thereto. An outflow conduit 24 is provided for the purpose of facilitating outflow of solution from cell 12 after the silver content has been recovered therefrom electrolytically. Fitting 20, which is a conventional design, has a lower end 26 that forms a threaded nipple. Threads 28 are generally of a deeper cut and steeper pitch than threads 18.

Figure 2:
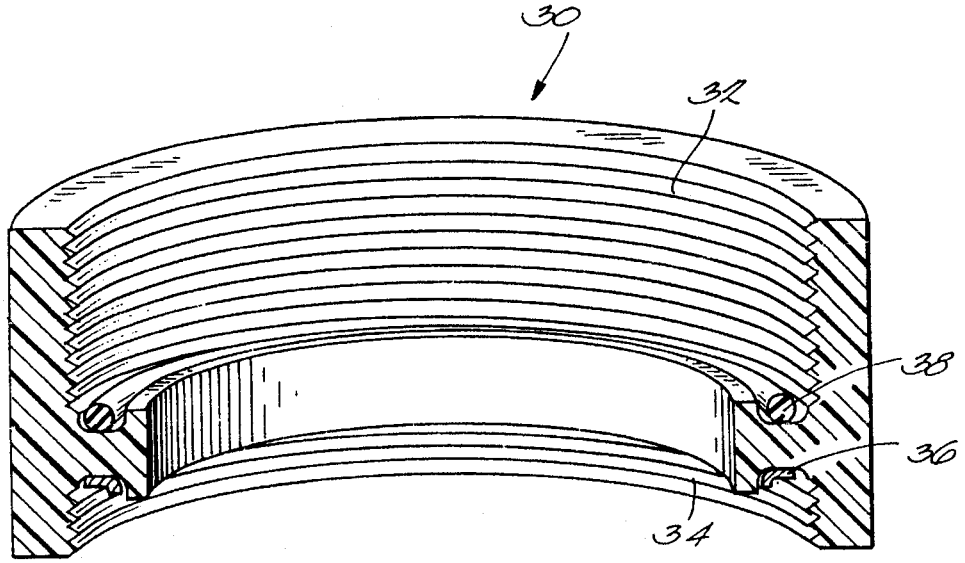
FIG. 2 is a central cross-sectional view of a connecting collar used in connection with the invention.

As best seen in FIG. 2, a collar 30 is provided to connect threads 28 of fitting 20 to threads 18 of container 12. To this end, the upper portion of collar 30 is cut with threads 32 that are of the same pitch and depth as threads 28 and, thus, are matingly threaded thereon. The lower end of collar 30 is provided with a second set of threads 34 adapted to matingly be threaded to the upper threads 18 on the upper end of container 12.

As seen in FIG. 2, suitable gaskets are provided to ensure a fluid-tight seal of the collar to the respective components of the system to which it is threaded. A ring gasket 36 of the general type utilized to seal glass jars is provided in the collar to abuttingly receive the upper end of container 12. A gasket 38, which may be in the form of an O-ring is provided to receive lower end 26 of fitting 20.

While the apparatus hereinbefore described is effectively adapted to fulfill the objects of the invention, it is to be understood that the invention is not intended to be limited to the specific preferred embodiment set forth above. Rather, it is to be taken as including all reasonable equivalents within the scope of the appended claims.

What is claimed is:

1. A cell for electrolytic silver recovery provided with a threaded fitting having a first set of threads, said cell being connected to a conventional fluid flow fitting having a second set of threads different from said first set of threads, said fitting having a fluid flow inlet and outlet by means of a collar connecting the dissimilar threads of the fitting and the cell, said cell being connected by an electric lead to an outside source of power and containing an electrode adapted for electrical contact with liquid when contained within the cell and a second electrode in the form of a thin conductive coating on the interior of the cell.

2. A cell for electrolytic silver recovery comprising a container including a connector for electrical connection to an outside electrical power source and a pair of electrodes, one of the electrodes adapted to be in electrical contact with liquid when contained in the container and the other electrode being affixed and in electrical contact with a metallic thin conductive film applied to an inside surface of the container, said container being provided with a first set of threads having a first set of dimensions including thread depth and pitch, said assembly including a fluid flow fitting having a first end with a fluid flow inlet and a fluid flow outlet and a second set of threads formed on a surface of the fitting having a second set of dimensions including thread depth and pitch, said second set of dimensions being different from said first set of dimensions, both of said inlet and said outlet being in fluid flow communication with the interior space defined by said set of threads, and a collar connecting the dissimilar threads of the fitting and the cell, said collar having a set of threads at one end thereof mating with said first set of threads and a set of threads on its opposite end mating with said second set of threads.

* * * * *